US005240195A

United States Patent [19]

Klaassen et al.

[11] Patent Number: 5,240,195

[45] Date of Patent: Aug. 31, 1993

[54] REPLACEABLE CASSETTE FOR AN ADHESIVE-TAPE DISPENSER

[75] Inventors: Willem Klaassen, St. Michielsgestel, Netherlands; Christoph Manusch, Hemmingen, Fed. Rep. of Germany

[73] Assignee: Pelikan Aktiengesellschaft, Hanover, Fed. Rep. of Germany

[21] Appl. No.: 765,659

[22] Filed: Sep. 25, 1991

[30] Foreign Application Priority Data

Sep. 26, 1990 [NL] Netherlands ..... 9002104

[51] Int. Cl.[5] ..... B65H 19/10

[52] U.S. Cl. ..... 242/55.53; 206/411; 225/23; 225/39

[58] Field of Search ..... 225/25, 23, 39, 41; 156/523, 527, 574, 577, 579, 584; 206/409, 411; 221/32, 46, 197; 222/325; 242/55.53

[56] References Cited

U.S. PATENT DOCUMENTS

| | | | |
|---|---|---|---|
| 1,787,882 | 1/1931 | Uttz, Sr. | 225/23 |
| 2,555,187 | 5/1951 | Erhardt | 225/25 X |
| 2,560,241 | 7/1951 | Pangburn et al. | 156/577 |
| 2,650,433 | 9/1953 | Krueger | 225/25 X |
| 2,671,271 | 3/1954 | Aldrich | 225/25 X |
| 2,681,186 | 6/1954 | Slawik | 225/44 |
| 3,586,587 | 6/1971 | Boyce | 156/577 X |
| 3,861,985 | 1/1975 | Parlagreco | 225/23 X |
| 4,238,271 | 12/1980 | Urushizaki | 156/577 X |
| 4,486,263 | 12/1984 | Monzo Gomez | 156/577 X |

FOREIGN PATENT DOCUMENTS

| | | | |
|---|---|---|---|
| 1153558 | 8/1963 | Fed. Rep. of Germany | 225/39 |

OTHER PUBLICATIONS

IBM Technical Disclosure Bulletin; vol. 25, No. 12; May 1983; pp. 6676–6677 "Molded Ribbon Cartridge With Brake"; J. A. Craft.

*Primary Examiner*—Douglas D. Watts
*Assistant Examiner*—Clark F. Dexter
*Attorney, Agent, or Firm*—Herbert Dubno

[57] ABSTRACT

A beak or bill shaped projection on the front end of a tape dispenser cassette is defined by a spring tongue and a pair of rigid strips on the front wall of the cassette which engage in a tape feed mechanism having at least a feed wheel engaging between the strips when the cassette is inserted into a tape dispenser.

10 Claims, 3 Drawing Sheets

REPLACEABLE CASSETTE FOR AN ADHESIVE-TAPE DISPENSER

FIELD OF THE INVENTION

Our present invention relates to a replaceable cassette for an adhesive-tape dispenser and, more particularly, to a dispenser of the type in which a replaceable cassette can be inserted and is provided with a supply roll of a tape having a pressure-sensitive adhesive along one surface thereof and formed with a dispensing opening through which the tape can be drawn from the cassette housing, the dispenser being provided with a mechanism for advancing the strip of adhesive tape.

BACKGROUND OF THE INVENTION

In tape dispensers of the type generally described, it is possible to apply an adhesive coated strip, namely the tape, directly to a substrate, such as a sheet of paper, by, for example, driving the aforementioned mechanism or drawing the dispenser over the paper or other substrate, thereby enabling the tape to be withdrawn from an opening in the cassette or cartridge and to be drawn off the roll therein. The cassette is replaceable and thus enables a fresh loaded cassette to be inserted into the dispenser without handling of the roll or manipulating a free end of the adhesive coated tape.

The cassette can be inserted into the dispenser and, in the past, the cassette has been relatively complex, requiring a spring loaded swingable lever to maintain the position of the tape. Upon insertion of the replacement cassette into the dispenser, the lever must be swung to render the device effective to deliver the tape. In some instances, the cassette also must be provided with transport or delivery wheels for advancing the adhesive tape.

German Patent Document DE-A 32 16 258 describes a hand-held device for the purposes described in which a replaceable cassette is provided with a supply spool or roll for a decorative tape and the cassette can be inserted into this dispenser. This cassette also can be considered to have a rather complex construction since it requires a rotatable bracing stirrup to be integrated therein and also includes the drive wheels.

OBJECTS OF THE INVENTION

It is the principal object of the present invention to provide a replaceable cassette for an adhesive-tape dispenser which can have a simple construction, which can be reliably inserted into the dispenser and which can ensure reliable withdrawal of the adhesive tape from the dispenser via a feed mechanism provided on the dispenser itself, rather than incorporated into the cassette.

Still another object of the present invention is to provide a dispenser of simple construction which can eliminate the need for complex mechanism integrated therein, but nevertheless can hold the free end of the tape in position for dispensing in a highly effective manner.

Still another object of the invention is to provide a replacement cassette for an adhesive-tape dispenser which avoids drawbacks of prior art systems.

SUMMARY OF THE INVENTION

These objects and others which will become more readily apparent hereinafter are attained, in accordance with the present invention, in a replaceable cassette for a dispenser provided with a mechanism for feeding the tape from the cassette and in which the dispensing opening is formed at the end of a beak-shaped or bill-shaped formation of the cassette housing. The bill-shaped formation may be generally of a duckbill shape, elongated at the end defining the outlet opening and projects at the front end or side of the cassette with respect to the direction in which the cassette is inserted into the dispenser.

The bill-shaped formation can be defined by a lower and an upper guide stirrup between which the tape passes. The lower guide stirrup can comprise two spaced apart strips formed on or fixed to the cassette housing and projecting parallel to one another therefrom in a common plane while being substantially rigid or stiff and defining between them a longitudinal gap. At these upper sides in the region of the free ends, each of these strips is rounded to a form guide path for the adhesive coated underside of the tape. The upper guide stirrup is formed by a spring tongue projecting from the cassette housing in the forward direction, i.e. the direction of insertion of the cassette into the dispenser and at its leading or front edge at its underside forms a rounded guide path for the upper surface of the adhesive strip. The free end of this tongue is rounded in the region juxtaposed with the rounded ends of the rigid lower strips and the tongue is spring-biased against the guide ends of the lower strip so that it can hold a tape end resiliently thereagainst.

More specifically, a replaceable cassette for an adhesive-tape dispenser, according to the invention, can comprise:

a cassette housing receiving a roll of adhesive tape to be dispensed and having a dispensing opening through which adhesive tape from the roll issues for advancing by a feed mechanism of the dispenser, the opening being formed by a bill-shaped extension of the housing projecting from a front side thereof in a direction of insertion of the cassette into the dispenser, the bill-shaped extension being formed by:

an upper and lower guide tongue between which the tape passes, the lower guide tongue comprising two substantially parallel strips substantially rigid with the housing and projecting therefrom, the strip being separated by an elongated gap, the strips being formed at upper portions with rounded guide ends over which an adhesive-coated underside of the tape runs, and the upper guide tongue comprising a spring blade projecting forwardly from the housing, the spring blade having a rounded free end juxtaposed with the guide ends of the strips, resiliently biased in a direction thereof, and pressing against an upper surface of the tape, the tongue being deflectable by the mechanism away from the strips to permit advance of the tape through the opening.

The bill-shaped portion at the front end of the cassette housing and formed with the dispensing opening between the two stirrups, enables the tape to be fed automatically upon insertion of the cassette into the dispenser into the tape-feed mechanism of the latter with high precision and to a predetermined location of this mechanism, e.g. between wheels which engage the upper and lower surfaces of the tape to advance it from the roll. The bill-shaped configuration of the projection ensures that the dispensing opening, in spite of the limited space which it occupies within the device and which is available in a hand-held device, need not be provided directly on the main portion of the cassette housing but rather can project therefrom and can converge away from this housing.

The configuration of this projection with its lower and upper stirrups, whereby the upper stirrup is intrinsically resiliently biased against and movable relative to the lower stirrup, ensures that the tape will be accurately guided between the curved surfaces of the two portions of the stirrups and further, as a consequence of the slot between the strips permit the feed roll of the mechanism on the dispenser proper to engage between the strips, bear upon the underside of the tape and lift the spring-loaded tongue away from the strips so that the tape can be advanced by this roller from the dispenser. The roller can be milled on its periphery for engagement with the adhesive underside of the tape and can press the tape against the curved path provided on the underside of the tongue. In addition or alternatively, the tongue may have a longitudinal slot in which an upper roller of the feed mechanism can engage for advance of the tape between these rollers.

While the lower strips may have their curved upper ends shaped to engage shaft stubs flanking the feed roller, thereby accurately positioning the cassette with respect to the mechanism so that this whole is straddled by the strips, the tongue is deflected upwardly by this roller and the tape can be pressed against the underside of this tongue.

With this lifting action, the engagement of the tape between the two stirrups is relieved and the tongue can form a surface against which the feed roller can press the tape, the feed roller can be dimensioned to lift the tape completely from the lower stirrup and hence the rounded edges of the lower strips so that adherence of the adhesive to these strips will not interfere with the feed of the tape.

As a result of the rounded configurations of the ends of the stirrups at the end of the bill-shaped projection, the tape can receive a curved path facilitating insertion of the tape into the aforementioned mechanism and in the nip between the rollers.

In an especially advantageous configuration of the cassette, therefore, the upper stirrup or tongue is likewise provided with a longitudinal slot opening toward its free end and in which an upper roller of the mechanism can be received, this slot being aligned with the longitudinal gap previously mentioned and running substantially over the entire curved end of the tongue.

By contrast with a system in which the tape is only engaged from below by a feed roller, this embodiment permits more reliable advance of the tape because it is seized in the nip between upper and lower rollers.

It has been found to be advantageous to provide the upper stirrup or tongue so that it projects beyond the rounded ends of the lower strip laterally so that upon insertion of the cassette into the dispenser, not only a single feed roller between the two strips in the aforementioned gap but further feed rollers on the aforementioned shaft laterally flanking the two strips can engage the tape and, by pressing the tape against the laterally projecting portions of the tongue, advance the tape from the cassette.

In this case, therefore, three feed rollers engage the underside of the tape and the stubs between them serve as rests for the free ends of the strips.

It has also been found to be advantageous, in accordance with the present invention, to provide the curved portions of the two stirrups so that they are of circular arc configuration and so that the radius of curvature of the curved underside of the tongue is greater than the radius of curvature of the curved upper ends of the strip. The differences in radii of curvature need not be very great. Even with a small difference in radii of curvature, we can obtain effective feed of the tape coming from the supply spool or roll in the regions between the upper and lower guide stirrups and thus effective feed from the dispensing opening.

Advantageously, the upper stirrup and/or the stirrup strip of the lower guide structure, at least in their rounded edge regions have a constant wall thickness with advantageously the wall thickness of the tongue being less than that of the strips.

It is possible to provide the spring tongue and/or the strips as separate parts which are fastened on the cassette housing. In this manner, it is possible to provide by choice of different materials, the different stiffnesses or resiliencies which are required. For example, the strips can be made of a relatively stiff material while the spring tongue can be a foam or elastic material.

Preferably, however, the spring tongue and the strips are composed of a single synthetic resin material and are formed in one piece with the cassette housing. This greatly simplifies fabrication of the cassette housing structure and the strips.

According to a further feature of the invention, in the cassette housing between the means supporting the supply roll and the periphery thereof and the dispensing opening, a rotatable retaining element is provided which can engage the adhesive coated side of the tape and hold the tape in the configuration of a loop away from the underside of the tongue at least at the upstream side thereof. The result is the formation of a compensating loop between the withdrawal part of the tape at the end of the bill-shaped projection and the outer periphery of the turns of the tape within the cassette, enabling a more uniform and reliable withdrawal of the tape as well as a reduction in the suddenness with which tension is applied to the tape. Furthermore, this limited loop prevents the tape from hanging excessively in the housing and thereby adhering to the front wall thereof which might prevent the tape from being effectively drawn through the housing. With this embodiment the tape is limited in the formation of the loop within the housing, since its adhesive underside comes to rest against this rotating element. The rotating element, of course, permits the tape to be drawn forwardly with ease.

The rotating element can be provided in various configurations and ways. For example, it can be formed as a small helical spring or a synthetic resin sleeve fitted with play on a transverse pin or shaft mounted on one of the side walls and readily rotatable thereon. The formation of the element as a small helical spring has the advantage that only a limited contact surface is provided for the adhesive coated side of the tape which, although sufficient to provide adhesion and prevent excessive sagging of the tape, can be readily released upon application of tension to the tape. A subsequent feed of the tape from the dispenser and application of the tape to the substrate can be effected without damage to the adhesive surface.

According to another feature of the invention, at least one sidewall of the cassette is removable. The cassette can be formed so that its housing can be separated along a longitudinal median plane and the two lateral parts thereof can be largely mirror symmetrical. Preferably, the cassette housing is provided with a guide element which cooperates with a guide surface on the dispenser upon insertion of the cassette into the dispenser, this guide surface and element additionally providing an abutment constituting a stop for the inserting movement of the cassette.

Without any swingable lever and without feed rollers built into the cassette, the replaceable cassette of the invention can provide a highly reliable supply of the adhesive tape. The cassette can be fabricated simply and economically and does not suffer breakdown for failure of complex mechanisms and lever arrangements.

BRIEF DESCRIPTION OF THE DRAWING

The above and other objects, features and advantages of our invention will become more readily apparent from the following description, reference being made to the accompanying drawing in which.

SPECIFIC DESCRIPTION

Figure 1:
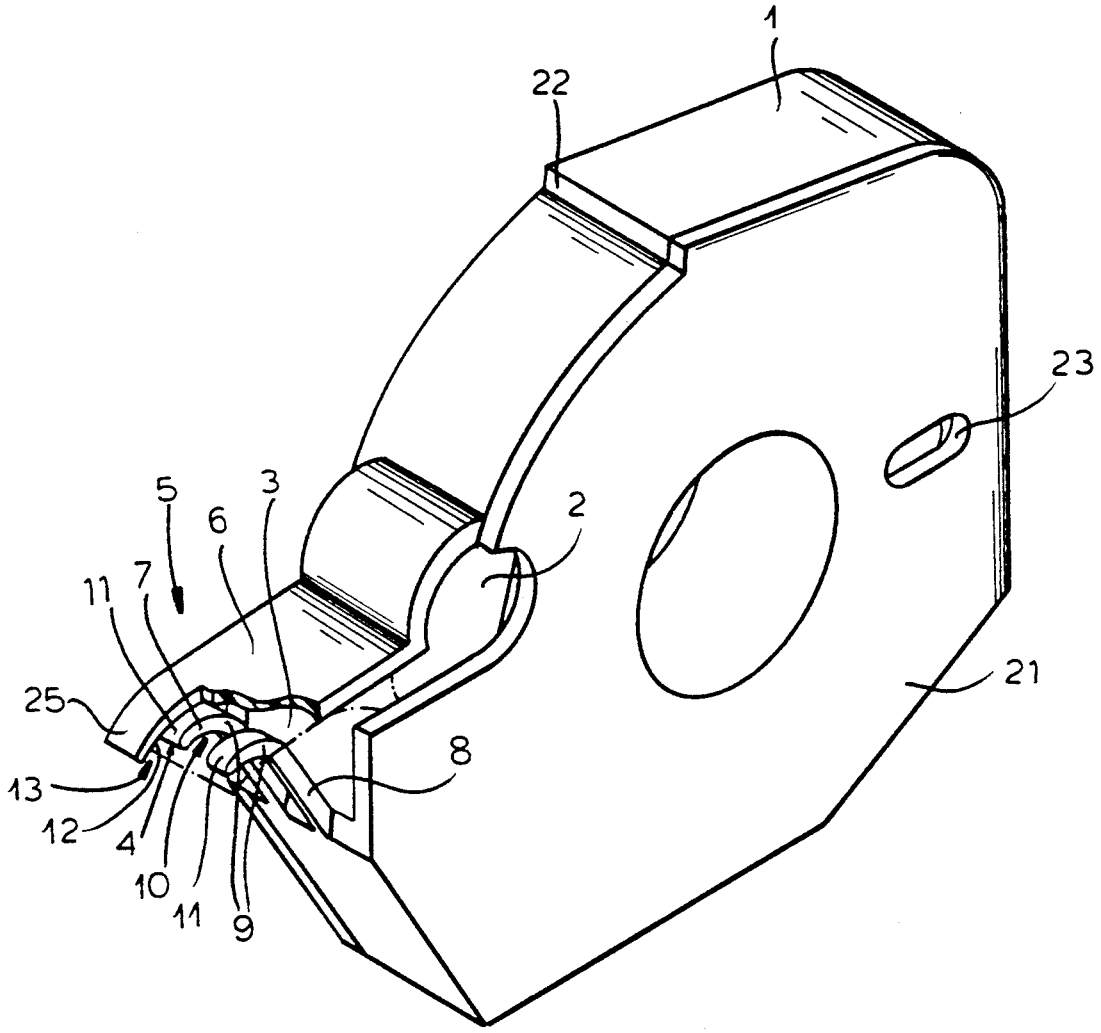
FIG. 1 is a perspective view, partly broken away, of a cassette according to the invention.

In the drawings, we show a replaceable cassette which can be received in a dispenser, represented only in dot-dash lines at 100, provided with a feed mechanism 101 for advancing the tape and formed with an abutment surface 102 against which the cassette can come to rest when fully inserted.

Figure 6:
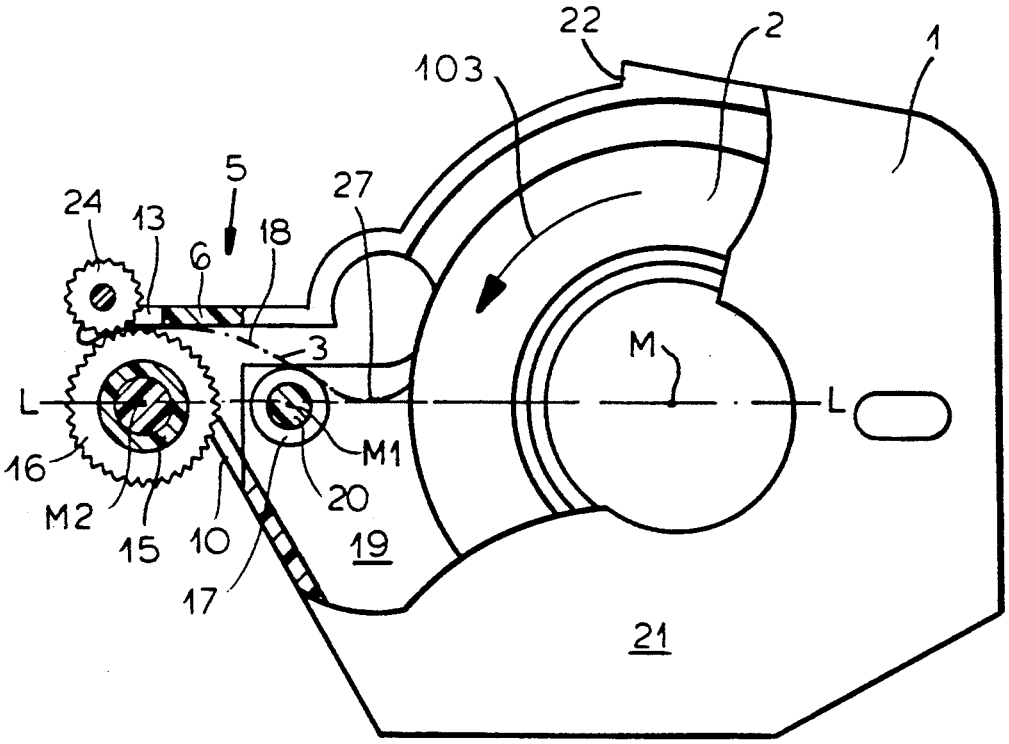
FIG. 6 is a side view, partly broken away of the cassette in place within a dispenser showing the internal relationships of the two rollers and their cooperation with the slots of the upper and lower stirrups of the cassette according to the invention.

The cassette comprises a cassette housing 1 which, as is especially apparent from FIG. 6, is provided in its interior with a supply spool or roll 2 of an adhesive tape 3, this spool or roll being rotatable in the direction of the arrow 103 within the cassette housing.

Figure 4:
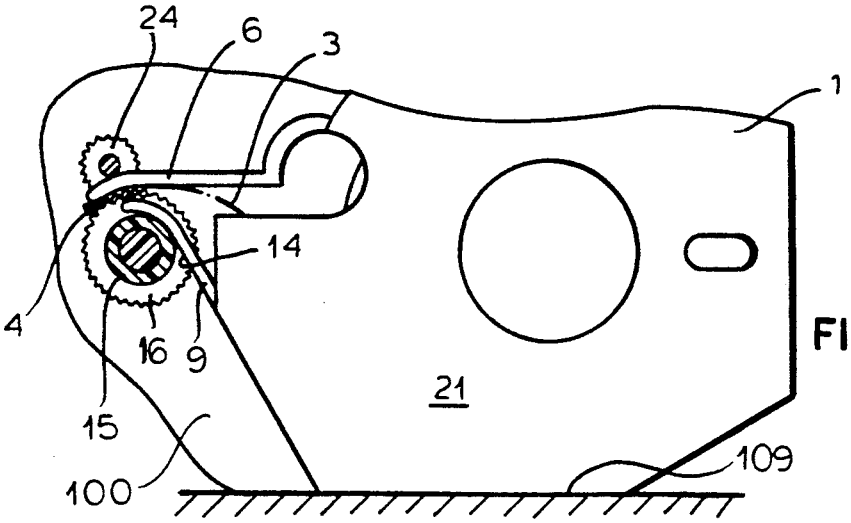

From the supply roll 2, at the front side of the housing 1 and as can be seen from FIGS. 1 and 4, the adhesive tape 3 can be withdrawn and fed through a dispensing opening 4 at the front end of a bill- or beak-shaped projection 5 which extends forwardly from the cassette housing 1 at the front side thereof with respect to a direction 104 of insertion of the cassette 1 into the dispenser 100.

This projection 5 is comprised of an upper guide stirrup 6 and a lower guide stirrup 9, the latter being formed from two stirrup strips 7, 8 which are parallel to one another and spaced apart by an intervening gap 10 extending longitudinally in the lower stirrup (FIG. 1). The stirrup strips 7, 8 project in one piece upwardly from the front lower part 112 of the cassette housing 1 and are formed in one piece with the front lower part 112.

At their upper ends, each of the strips 7, 8 has a circular arc curvature. They, therefore, form with their upper sides, the circular arc curved guide path 11 for the tape 3. Both strips 7, 8 are so formed that they are substantially rigid and stiff.

The upper guide stirrup 6 projects forwardly from the cassette housing 1 in the form of a spring tongue and overlies from above the adhesive tape 3 overlying the lower guide stirrup 9.

Figure 2:
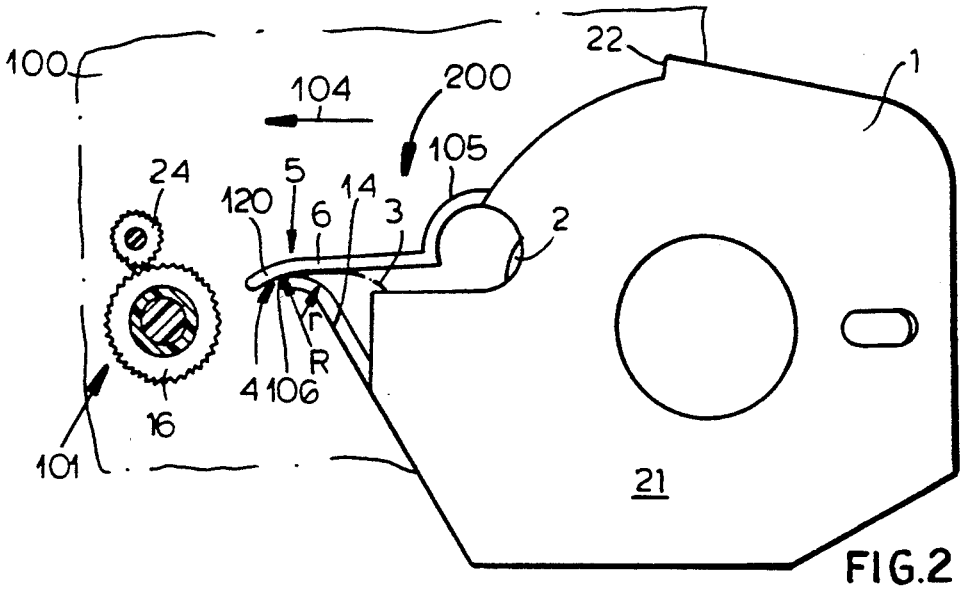
FIG. 2 is a side-elevational view showing the initial stage of insertion of the cassette into the dispenser shown only diagrammatically.

The spring tongue 6 is biased resiliently by a spring force in a direction indicated by an arrow 200 in FIG. 2 toward the strips 7, 8 and thus holds the tape 3 thereagainst. The resiliency is imparted by the shape of the tongue 6 which has the configuration shown in FIG. 1 and comprises at a rear end of the tongue a circular arc connection 105 to the front upper part 110 of the housing 1.

At the free end, the tongue 6 is bent at 106 with a circular arc curvature.

The cassette housing 1, the tongue 6 and the strips 7, 8 can be composed of a synthetic resin material. The wall thickness d of the tongue is not less than the wall thickness D of the strips 7, 8 and the resilience is created by the angular junctions 107 and 108 at the ends of the curved portion 105 of this tongue generating thereby the spring force.

Since the tongue 6 is resiliently movable against the strips 7, 8, the portions thereof which are laterally flanked by the housing 1 are free from engagement thereby to permit this vertical movement.

At its front end region, the spring tongue 6 is also formed with a curved engaging surface 12 of circular arc curvature and which presses against the adhesive tape 3 resting upon the guide surface 11 formed by the stirrup strips 7, 8. As can be seen from FIG. 2, the radius of curvature R of the engaging surface 12, which rests against the nonadhesive upper surface of the tape, is somewhat greater than the radius of curvature r of the guide surface 11 at the upper side of the strips 7, 8. As a consequence, at the inlet side and the outlet side of the dispensing opening 4 defined between the surfaces 11 and 12, conditions are provided for easy passage of the adhesive tape 3 into and out of the dispensing opening 4.

The spring tongue 6 is, at its free end, formed as two spring fingers 120 and generally in a central region thereof formed with a longitudinal slot 13 between the spring fingers 120 (see FIGS. 1, 5 and 6) which is open toward the edge of the free end of the tongue 6 and reaches rearwardly over at least the entire region of the rounded surface 12. As is particularly clear from FIG. 5, the longitudinal slot 13 is thus directly over the longitudinal gap 10 defined between the strips 7, 8, and may be slightly wider than the gap 10.

Within the cassette housing 1, at a front region thereof between the outer periphery of the roll or spool 2 and the dispensing opening 4 or the curved end regions of the stirrup strips 7 and 8, we provide a rotatable element 17 which can be received with a small amount of play on a transverse pin 20 between the side walls 19 and 21 of the cassette housing 1. The pin 20, which spans between these sidewalls, can be mounted on one of the sidewalls, e.g. the sidewall 19. The rotatable element 17 is, in the embodiment of FIG. 6, in the form of a plastic sleeve although it can be some other rotatable element which is in limited contact with the tape, for example, a small helical spring loosely received on the transverse pin 20.

The tape 3 drawn from the supply spool 2 can form a downwardly extending compensating loop 27 (FIG. 6) at which its adhesive coated underside rests upon the element 17 and can adhere thereto with slight force. From the element 17, an upwardly extending loop 18 can run to the dispensing opening 4 so that the loop 18 lies against the underside of the spring tongue 6 at a distance upstream of the dispensing opening 4 and along its upper side, runs to the dispensing opening 4.

The housing is, in addition, and as shown in FIG. 1 and on the sidewall 21 in FIGS. 1–4 and 6, provided at its rear portion with an elongated viewing slot 23 through which the extent of filling of the supply spool can be determined from the exterior. Thus the user can readily discern the extent to which the tape has been used.

In the illustrated embodiment, this sidewall 21, together with the front lower wall from which the strips 7 and 8 project, can be removable from the housing and can be connected to the remainder of the housing with fastening pins or webs to enable frictional assembly of the two housing parts. The fact that the housing can be disassembled in this manner enables replacement of the spool with a new spool if desired.

Instead of providing the sidewall 21 so that it is removable, the entire housing can be subdivided into two mirror-symmetrical halves along a longitudinal median plane and the halves can be assembled by pin or post connections. So that the two halves are as symmetrical as possible, viewing slots 23 can be provided on both sidewalls 19 and 21.

The transverse pin 20, which forms the axis upon which the rotating element 17 can be mounted, is so provided, as is visible in FIG. 6, that upon insertion of the cassette into the dispenser, the axis M1 of the pin 20 lies along the line L—L connecting the axis M of the supply spool 2 and the axis M2 of the feed roller 16 which engages in the longitudinal gap 10 between the strips 7 and 8 when the cassette is properly located in the tape dispenser.

Figure 3:
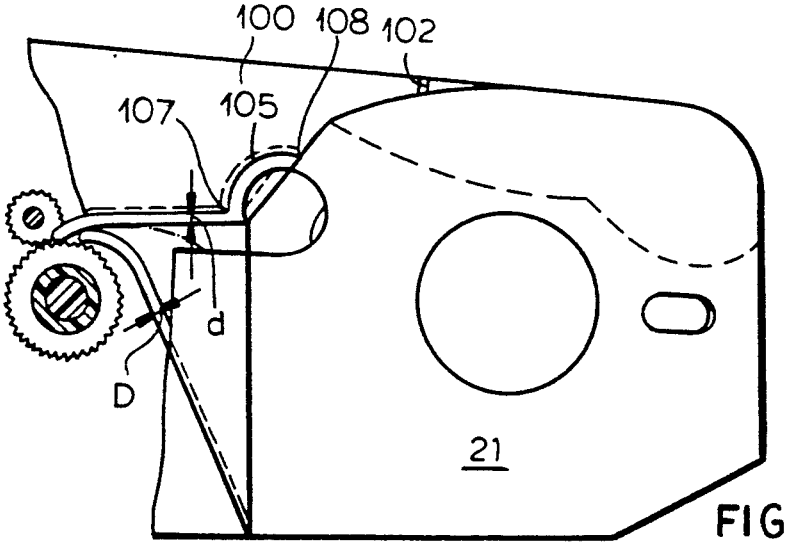
FIGS. 3 and 4 are diagrammatic side-elevational views showing the subsequent stages of insertion of the cassette, respectively, when the cassette reaches the feed mechanisms and when the bill-shaped projection is inserted fully into this mechanism.

FIGS. 2–4 show schematically the relative positions of the replacement cassette and the feed roller mechanism of the dispenser. In the dispenser, this mechanism comprises two tape feed rollers 16 and 24 whose peripheries are milled as is shown by zig-zag lines in the drawing so that these rollers can obtain a better grip upon the tape. The peripheries of these rollers lie close enough to one another that the tape is engaged with slight pressure between them and will be transported by these rollers. FIG. 2 shows the state at the beginning of insertion of the cassette into the dispenser. The beak-shaped projection in this illustration is clearly spaced from the two rollers 16 and 24.

As the cassette is inserted further (FIG. 3), the upper spring tongue 6 and the strips 7 and 8 come into proximity of the rollers 16 and 24. The configurations of the spring tongue 6 and of the strips 7 and 8 are such, as is apparent from FIG. 3, that the end of the tongue 6 rides up upon the roller 16 while the roller 16 enters the gap 10 and the roller 24 enters the slot 13. As the cassette is inserted further, finally reaching the position shown in FIG. 4, the tape 3 previously clamped between the surfaces 11 and 12, rests upon the roller 16 and is held by the roller 16 against the tongue 6 and lies between the rollers 16 and 24. The curved portions of the strips 7 and 8 come to rest upon the shaft stubs 15 axially flanking the roller 16 engaged within the longitudinal gap 3. The roller 16 has lifted the tongue 6 away from the strips 7 and 8.

As a consequence, upon rotation of the rollers 16 and 24 in the counterclockwise and clockwise senses respectively (FIGS. 2–4), the tape will feed from the opening 4.

Figure 5:
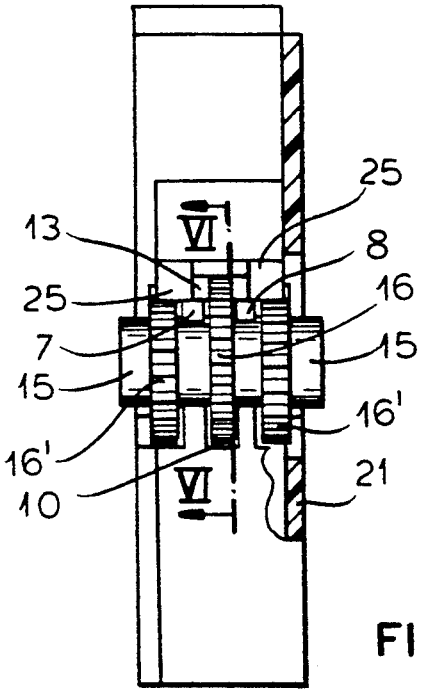
FIG. 5 is a front view, partly in cross-section, showing the cassette in place within a dispenser which does not have an upper feed roller.

The dispenser is shown in its inserted position with respect to the mechanism 16, 24 also in FIGS. 5 and 6. FIG. 6 shows the cassette in section along the plane VI—VI of FIG. 5.

FIG. 6 also shows in somewhat more detail, the path of tape between the rollers 16 and 24 and their positions within the longitudinal gap 10 and the slot 13.

As the front view provided by FIG. 5, from which the upper roller 24 has been omitted, will show, on the axis of the roller 16 and laterally spaced therefrom by the width of the strips 7 and 8, are two further lateral tape feed rollers 16′ which need not cooperate with upper tape rollers and merely serve to engage the adhesive surface of the tape as it is advanced. These rollers 16′ may bear upon portions 25 of the tongue 6 flanking the slit 13 and biased by these wheels 16′ upwardly. The intrinsic resiliency of the tongue 6 provides the pressure retaining the tape against the wheel 16′.

As soon as the cassette is in the position shown in FIGS. 4 and 6, the dispenser can be used to feed the tape as is conventional.

At the upper side of the cassette housing 1, an abutment 22 is provided to cooperate with the abutment 102 of the dispenser to limit the insertion in the direction of arrow 104 and ensure accurate positioning of the cassette in the dispenser as is indicated in FIG. 4, the bottom of the cassette can rest upon a supporting surface 109 of the dispenser as well, preferably in a guide groove of the latter to facilitate accurate sliding of the cassette therein.

The cassette is preferably formed of an appropriate plastic, for example, a thermoplastic synthetic resin and produced by injection molding for simplifying fabrication.

We claim:

1. A replaceable cassette for an adhesive-tape dispenser, comprising:

a cassette housing receiving a roll of adhesive tape to be dispensed and having:

a top side, a top front side being unitary with said top side, a bottom front side, said top and bottom front sides forming a bill-shaped extension projecting from the housing in a direction of insertion of said cassette into said dispenser and provided with a dispensing opening in said bill-shaped extension through which adhesive tape from said roll issues for advancing by a feed mechanism of said dispenser, said bill-shaped extension being formed by:

an upper and lower guide tongue between which said tape passes, said lower guide tongue comprising two substantially parallel strips substantially rigid with said bottom front side of the housing and projecting therefrom in said direction of insertion, said strips being separated by an elongated gap and being formed at upper portions with longitudinally rounded guide ends over which an adhesive-coated underside of said tape runs, and said upper guide tongue comprising a spring tongue projecting forwardly from and unitary with said top front side, said spring tongue having at least one longitudinally rounded free end juxtaposed with said guide ends of said strips, resiliently biased in a direction toward said guide ends of said strips, for pressing against an upper surface of the tape, said spring tongue being deflectable by said feed mechanism away from said strips to permit advance of said tape through said opening.

2. A replaceable cassette for an adhesive-tape dispenser, comprising:

a cassette housing receiving a roll of adhesive tape to be dispensed and having a dispensing opening through which adhesive tape from said roll issues for advancing by a feed mechanism of said dispenser, said opening being formed by a bill-shaped extension of said housing projecting from a front side thereof in a direction of insertion of said cassette into said dispenser, said bill-shaped extension being formed by:

an upper and lower guide tongue between which said tape passes, said lower guide tongue comprising two substantially parallel strips substantially rigid with said housing and projecting therefrom, said strips being separated by an elongated gap, said strips being formed at upper portions with longitudinally rounded guide ends over which an adhesive-coated underside of said tape runs, and said upper guide tongue comprising a spring tongue projecting forwardly from said housing and being formed at a forward end with two spring fingers separated by a longitudinal slot opening wherein said opening is disposed above said elongated gap between said strips, said forward end of each of said spring fingers being a longitudinally rounded free end juxtaposed with and being resiliently biased in a direction toward said guide ends of said strips for pressing against an upper surface of the tape, said slot opening extending between said rounded free ends of said spring fingers, said spring fingers being deflectable by said feed mechanism away from said strips to permit advance of said tape through said opening.

3. The replaceable cassette for the adhesive-tape dispenser defined in claim 2 wherein said rounded free ends of said spring fingers and said rounded guide ends are of circular arc-segmental configuration and a radius of curvature (R) of an underside of said rounded free end is greater than a radius of curvature (r) of said rounded guide ends.

4. The replaceable cassette for the adhesive-tape dispenser defined in claim 2 wherein said spring fingers are formed, at least along said rounded free ends, with a constant wall thickness and said strips are formed, at least along said rounded guide ends, with a constant wall thickness.

5. The replaceable cassette for the adhesive-tape dispenser defined in claim 4 wherein said wall thickness of each of said rounded free ends of said spring fingers is less than said wall thickness of said rounded guide ends of said strips.

6. The replaceable cassette for the adhesive-tape dispenser defined in claim 2 where at least one of said strips and said tongue is constituted of a plastic material.

7. The replaceable cassette for the adhesive-tape dispenser defined in claim 6 where at least one of said tongue and said guide strips is formed in one piece with said cassette housing.

8. The replaceable cassette for the adhesive-tape dispenser defined in claim 6 combined with the dispenser wherein undersides of said guide ends of said strips are positioned to rest upon lateral shaft stubs of said dispenser, said dispenser having a shaft provided with a tape extraction roller inserting through said gap between said rounded guide ends and against said underside of said tape.

9. The replaceable cassette for the adhesive-tape dispenser defined in claim 2 further comprising, between said roll and said opening, a rotatable element received in said housing and on which said adhesive coated underside of said tape rides to form a loop of said tape in which said upper surface of said tape is deflected away from said tongue remote from said opening.

10. The replaceable cassette for the adhesive-tape dispenser defined in claim 2 wherein said rounded free ends of said spring fingers project forwardly beyond said rounded guide ends of said strips.

* * * * *